United States Patent [19]

Carr et al.

[11] 4,203,839

[45] May 20, 1980

[54] PROCESS FOR SEPARATING SOLIDS FROM COAL LIQUIDS

[75] Inventors: Norman L. Carr, Allison Park; Edgar L. McGinnis, Gibsonia, both of Pa.

[73] Assignee: Gulf Research and Development Company, Pittsburgh, Pa.

[21] Appl. No.: 893,085

[22] Filed: Apr. 3, 1978

[51] Int. Cl.[2] ..... B01D 37/02

[52] U.S. Cl. ..... 210/71; 210/75

[58] Field of Search ..... 210/75, 65, 69, 70, 210/71, 73 W, 51, 52, 56, 500 R, 193; 208/8 LE, 8 R, 11

[56] References Cited

U.S. PATENT DOCUMENTS

| | | | |
|---|---|---|---|
| 3,138,551 | 6/1964 | Jones | 210/75 |
| 4,046,690 | 9/1977 | Rodgers et al. | 210/193 |

FOREIGN PATENT DOCUMENTS

| | | | |
|---|---|---|---|
| 2522746 | 12/1975 | Fed. Rep. of Germany | 208/8 LE |
| 2625690 | 1/1977 | Fed. Rep. of Germany | 210/75 |

*Primary Examiner*—Benoît Castel

[57] ABSTRACT

The rate of separation of suspended mineral particles from a coal liquid is increased by adding a calcium salt, such as calcium carbonate, to the coal liquid. The increase in the separation rate is achieved even though the suspended coal mineral particles naturally contain a calcium salt.

14 Claims, No Drawings

PROCESS FOR SEPARATING SOLIDS FROM COAL LIQUIDS

This invention relates to a process for removing suspended coal mineral particles from coal liquids. Although the suspended particles are referred to herein as coal mineral particles, it is understood that the term coal minerals includes mineral residue or insoluble organic matter or a combination of the two.

Several processes are now being developed for producing deashed liquid and/or solid hydrocarbonaceous fuels from raw coal. One such process is known as the Solvent Refined Coal (SRC) process. This process is a solvation process and is described in a number of patents, including U.S. Pat. No. 3,884,794, which is hereby incorporated by reference. In this process, crushed raw coal is slurried with a solvent comprising hydroaromatic compounds in contact with hydrogen in a first zone at a high temperature and pressure to dissolve hydrocarbonaceous fuel from coal minerals by transfer of hydrogen from the hydroaromatic solvent compounds to the hydrocarbonaceous material in the coal. The mixture is then passed to a second zone wherein dissolved hydrocarbonaceous material reacts with hydrogen while the solvent also reacts with hydrogen to replenish hydrogen lost in the first zone. The hydrogen-enriched solvent is recycled. The dissolved coal liquids contain suspended particles of coal minerals and undissolved coal. The particles are very small, some being of submicron size, and are therefore very difficult to removed from the dissolved coal liquids.

In accordance with the present invention, a solid calcium salt, such as calcium carbonate, is added to a coal liquid, such as the liquid product of a coal solvation process containing suspended or dispersed particles of mineral residue, prior to a step for the separation of the suspended particles of mineral residue. We have found that the addition of a calcium salt allows the coal mineral solids to be separated from the coal liquid at a more rapid rate than would otherwise be possible. Any of the known methods for solids-liquid separation can be applied to a calcium salt-treated coal liquid, including filtration, settling, hydrocloning or centrifugation. Unlike a filter aid which mechanically assists a filtration type of separation only, the calcium salt of this invention assists all methods of solids separation. However, because of the rapid rate of solids removal demonstrable by filtration, the present invention is illustrated in the following examples by the filtration method of solids separation.

It is shown in the following examples that commercial diatomaceous earth filter aid exerts a negative effect upon the filtration rate of a coal liquid when it is added directly to the coal liquid as a body feed. In fact, it has been the experience of the coal liquefaction art that materials known as filter aids and which impart a mechanical effect upon the filtration operation improve the filtration rate of coal liquids only when utilized as a filter precoat material. The finding herein that calcium carbonate improves the filtration rate of coal liquids when added directly to the coal liquid being filtered indicates that it does not function as a filter aid. The examples presented below show that the improvement in filtration rate due to the effect of calcium carbonate is distrinct from and can be superimposed upon the improvement due to the use of a filter aid as a precoat material.

Data presented below provide strong evidence that the discovered advantageous effect of an added calcium salt upon the rate of filtration of a coal liquid is chemical in nature, as contrasted to the mechanical effect exerted by calcium carbonate as a conventional filter aid in filtration systems of the prior art. For example, data are presented below which show that calcium carbonate did not increase the rate of filtration of a coal liquid in filtration tests performed at 400° F. (204° C.), but did increase the filtration rate in similar tests performed at 500° F. (260° C.). If the effect of the calcium carbonate were of the conventional mechanical filter aid type, an improvement in filtration rate would have been apparent at the 400° F. (204° C.) filtration temperature.

The fact that the naturally occurring minerals which are suspended in coal liquids and which are removed during the filtration operation are known to contain a considerable quantity of calcium salts, such as calcium carbonate, constitutes additional evidence that the added calcium salt does not exert a mechanical effect in the filtration procedure. If the effect were mechanical, the calcium carbonate naturally present would itself act as a filter aid. The natural minerals suspended in the coal liquid render the coal liquid extremely difficult to filter, indicating that the effect of the added calcium salt in accordance with this invention is due to a factor other than the mere presence of calcium carbonate in the coal liquid.

Although we are not bound by any theory, a chemical effect may occur in the coal liquid due to reaction of the added calcium salt with carbon dioxide, which is naturally occurring in the coal liquid, resulting in the crystallization of a coating of calcium carbonate around individual suspended particles of coal minerals, thereby enlarging these particles to render them easier to separate. The coating may also form around a plurality of suspended particles, forming aggregates or clusters of particles. The naturally occurring calcium carbonate in the suspended coal mineral particles may exert a seeding effect for the crystallization of fresh calcium carbonate, or other minerals in the suspended particles may catalyze the crystallization of calcium carbonate around the suspended mineral particles. If the added calcium salt is calcium carbonate, carbon dioxide may be released by the calcium carbonate upon mixing with or dissolution in the coal liquid and then be available for the recrystallization. Aside from this released carbon dioxide, carbon dioxide is abundantly available in the coal liquid whether the liquid is under atmospheric or superatmospheric pressure due to its production in the coal liquefaction process because of the considerable rupturing of hydrocarbonaceous coal molecule chains which occurs in the vicinity of carbon-oxygen bonds, which constitute a weak link in the chain.

A test was conducted to confirm that a coal liquid environment was conducive to the crystallization of calcium carbonate. In this test, calcium acetate was added to tetralin, which is an important component in a solvent for liquefying coal. A carbon dioxide atmosphere was maintained at coal liquefaction temperature and pressure. Calcium carbonate was produced and recovered by filtration. This test demonstrated that calcium carbonate crystallization occurs in a solvent liquid used for coal liquefaction from a calcium salt in the presence of carbon dioxide.

Any calcium salt can be employed in accordance with this invention which is capable of forming a stable and homogeneous mixture or dispersion in the coal liquid, enabling it to crystallize as calcium carbonate around individual or groups of suspended mineral particles by reacting with carbon dioxide. A combination calcium salt, such as dolomite, which is $CaCO_3$. $MgCO_3$, can be employed. Dolomite is also naturally occurring in coal minerals.

Many references disclose the general utility of calcium carbonate as a filter aid in systems other than coal liquids. For example, U.S. Pat. No. 3,138,551 to Jones discloses a process for the filtration of alkaline or caustic liquor in which calcium carbonate particles are utilized as filter aid. The Jones patent reported that in the filtration of sodium aluminate liquor the crystalline form of calcium carbonate known as aragonite was found to be superior as a filter aid as compared to the crystalline form known as calcite. The patent reported that the calcite particles are small, being in the form of spheres having a uniform particle diameter of about 2.5 microns, while aragonite particles are larger, being needle-like and having a width of about one to five microns and a length of about five to about forty microns.

Since the Jones patent reported that the calcium carbonate functioned as a filter aid, the finding that the relatively large aragonite particles were more effective than the smaller calcite particles was to be expected. A filter aid performs the mechanical function of spacing removed particles at the filter medium during a filtration operation to provide an open channel for the flowing liquid. Relatively large particles of filter aid material are generally superior to smaller particles of filter aid material for providing a mechanical spacing function of this type. In contrast, as explained above, in the filtration of coal liquids the calcium carbonate exerts a chemical effect rather than a mechanical effect. Since this chemical effect involves reaction and possibly dissolving of calcium carbonate, it would be expected that the calcite form of calcium carbonate, which has a smaller particle size, would be highly effective. The examples presented below show that the calcite form of calcium carbonate was highly effective for imparting a substantial increase to the filtration rate of coal liquids. Unlike systems utilizing a conventional filter aid, which exerts a mechanical effect, wherein the small size of the calcite would be an unfavorable factor, the addition of small sized calcite particles was a favorable factor in the filtration of coal liquids.

The calcium carbonate employed in the following filtering tests was purchased under the trade name of "Carbium." It comprised calcium carbonate of 96.6 percent purity, substantially entirely in the calcite crystalline form. The calcite particles ranged in size from 0.7 to 9 microns, averaging 2 microns, and were retained on a 325 mesh screen. In the filtration tests, the solid particles were sprinkled into the indicated liquid and stirred to form a homogeneous mixture or solution.

The weight of added solid calcium salt based on volume of mineral-containing coal liquid to be employed in accordance with this invention will vary depending upon the particular calcium salt employed, but will be between about 1 and 100 grams per liter, generally, and between about 10 and 50 grams per liter, preferably. The calcium carbonate is preferably added to the coal liquid as a body feed prior to filtration, but can also be utilized as a precoat material, or as both a precoat material and a body feed. When calcium carbonate is the calcium salt which is employed, the solids-liquid separation step should occur at a temperature above 400° F. (204° C.), preferably above 425° or 450° F. (218° or 232° C.). Highly superior results are achieved at temperature of 475° or 500° F. (246° or 260° C.), or higher. Filtration temperature can range as high as 600° F. (316° C.) in SRC pressurized filters. The calcium carbonate can be added at the same or at a lower or higher temperature than the temperature of the solids-liquid separation step. The calcium salt addition or solids separation step can occur at atmospheric or superatmospheric pressure. In a filtration operation, the pressure must be sufficiently high to operate the filter, and will be in the range 50 to 600 psi (3.5 to 42 kg/cm$^2$), generally, or 100 to 200 psi (7 to 14 kg/cm$^2$), preferably.

In performing the filtration tests of the following examples, a 90 mesh screen located within the filter element was precoated to a depth of 0.5 inch (1.27 cm) with diatomaceous earth. The filter element measured 1.9 cm I.D. by 3.5 cm in height and provided a surface area of 2.84 cm$^2$. The screen was supported by a sturdy grid to prevent deformation. The precoat operation was performed by pressuring a 5 weight percent suspension of the diatomaceous earth precoat material in process light oil onto the screen using a nitrogen pressure of 40 psi (2.8 kg/cm$^2$). The precoat operation was performed at a temperature close to that of the subsequent filtering operation. The resulting porous bed of precoat material weighed about 1.2 grams. After the precoat material had been deposited, nitrogen at a pressure of about 5 psi (0.35 kg/cm$^2$) was blown through the filter for about 1–2 seconds to remove traces of light oil. The light oil flowed to a container disposed on an automatic weighing balance. The light oil was weighed to insure deposition of the required quantity of precoat material. Following this operation, the light oil was discarded. The balance was linked to a recorder for later use which provided a continuous (at 5 second intervals) printed record of filtrate collected as a function of time.

A 750 gram sample of unfiltered oil (UFO) without any additive was then introduced into a separate autoclave vessel which acted as a reservoir. The UFO was maintained at a temperature of 100°–130° F. (38°–54° C.) and was continuously stirred. Stirring was accomplished using two 5 cm diameter turbines. The shaft speed was 2,000 rpm. The filtration was begun by applying a selected 40–80 psi (2.8–5.6 kg/cm$^2$) nitrogen pressure to the autoclave. The UFO flowing from the autoclave passed through a preheater coil whose residence time was controlled by the manipulation of valves and which was provided with inlet and outlet thermocouples so that the UFO reaching the filter was maintained at a uniform temperature. The UFO passed from the preheater to the filter where solid cake was formed and filtrate obtained. The filter element and filter heater were also fitted with thermocouples. As indicated above, filtrate was recovered on a balance and its weight was automatically recorded every five seconds. The filtrate was collected in a clean container.

Comparative tests to determine the effect of a calcium carbonate additive were performed using the same feed lot of UFO for which filtration data had been collected. First, the system tubing and the filter were purged of UFO with nitrogen at a pressure of about 100 psi (7 kg/cm$^2$). The additive was introduced into the autoclave reservoir containing UFO. A separate filter element was fitted and precoated in the same manner as described above and the tests employing an additive in the UFO were performed as described in the following examples. Following each filtration, the residue on the precoat material in the filter was purged with nitrogen and washed with an appropriate liquid to eliminate the UFO.

Following is an analysis of a typical unfiltered SRC feed coal liquid employed in the tests of the following examples. Although some light oil is flashed from the oil feed to the filter in process pressure step-down stages, the filter feed oil has not experienced removal of any of its solids content prior to filtration.

Specific gravity, 60° F. (15.6° C.), 1.15
Kinematic viscosity at 210° F. (98.8° C.), 24.1 centistokes
Density at 60° F. (15.6° C.), 1.092
Ash, 4.49 weight percent
Pyridine insolubles, 6.34 weight percent
Distillation, ASTM D1160

| Percent | Temp. °F. (°C.) at 1 atm. |
|---|---|
| 5 | 518 (270) |
| 10 | 545 (285) |
| 20 | 566 (297) |
| 30 | 602 (317) |
| 40 | 645 (341) |
| 50 | 695 (368) |
| 60 | 768 (409) |
| 70 | 909 (487) |
| 71-recovery of all distillables occurs at 925° F. (466° C.) | |

EXAMPLE 1

A slurry of mineral residue-containing coal liquids was filtered at a temperature of 500° F. (260° C.) with a filter pressure drop of 80 psi (5.6 kg/cm$^2$). The coal liquid filtered in these tests, denoted as Feed A, was filtered with and without added calcite. In the test employing calcite, solid calcite was sprinkled into the coal liquid at room temperature and the liquid was then stirred. Subsequently, the mixture was heated to filtration temperature. The calcite formed a homogeneous mixture or dispersion. The filtering rates reported are for the first minute of filtration.

| Coal liquid | Additive weight percent | Filtration rate (g/min) |
|---|---|---|
| Feed A | none | 4.5 |
| Feed A | calcite, 2.7% | 5.8 |

The data show that the solid calcite additive imparted a significant improvement in filtration rate.

EXAMPLE 2

The filtering conditions employed in this example were similar to the filtering conditions of the tests of Example 1 except that the coal liquid containing the added calcite was held at the filtration temperature for 60 minutes prior to filtration.

| Coal liquid | Additive weight percent | Filtration rate (g/min) |
|---|---|---|
| Feed A | none | 4.5 |
| Feed A | calcite, 1.3% | 6.8 |
| Feed A | calcite, 2.7% | 5.7 |

A comparison of the 2.7% calcite tests of this example and of Example 1 indicates similar results are achieved whether or not the calcite-filter feed mixture is held at filtration temperature for 60 minutes prior to filtration.

EXAMPLE 3

Filtering tests were performed using a mineral residue-containing coal liquid, denoted as Feed B. The temperature of the coal liquid during the filtration tests was 500° F. (260° C.) and the pressure drop across the filter was 80 psi (5.6 kg/cm$^2$). One test was performed without a filter aid, while another test was performed after suspending a diatomaceous earth filter aid in the coal liquid. In the tests, the filter was precoated with a filter aid as described above. The filtering rates reported are for the first minute of filtration.

| Coal liquid | Additive weight percent | Filtration rate (g/min) |
|---|---|---|
| Feed B | none | 3.9 |
| Feed B | diatomaceous earth, 1% | 2.4 |

The above data show that a body feed diatomaceous earth filter aid has a negative effect upon filtration rate. It is known in the art that filter aids which exert a mechanical or non-chemical effect are not beneficial when employed as a body feed in the filtration of coal liquids, i.e. when mixed with the feed liquid flowing to the filter. It is also known in the art that filter aids whose effect is mechanical do exert a beneficial effect in the filtration of coal liquids when employed as a filter precoat material.

EXAMPLE 4

Additional filtering tests were performed using a mineral-containing coal liquid, designated as Feed C, to compare the effect of various non-reactive materials with calcite upon the filtration rate of the coal liquid. The tests were performed with the coal liquid at a temperature of 500° F. (260° C.) with a filter pressure drop of 80 psi (5.6 kg/cm$^2$). In all tests, the filter was precoated with a filter aid as described above. The filtration rates reported are for the first minute of filtration.

| Coal liquid | Additive, weight percent | Additive particle size | Filtration rate (g/min) |
|---|---|---|---|
| Feed C | none | — | 1.0 |
| Feed C | sand, 0.7% | 80–100 mesh | 1.1 |
| Feed C | neutral alumina, 0.7% | 80–100 mesh | 0.3 |
| Feed C | calcite, 0.7% | <325 mesh | 2.2 |

The above data show the calcite effected a substantial improvement in filtration rate, while sand and neutral alumina accomplished little or no improvement in filtration rate. Since sand and neutral alumina presumably exert a mechanical effect at the filter without benefit, it is apparent that calcite achieves its advantage in a different manner, i.e. by a chemical effect.

EXAMPLE 5

Tests were performed to illustrate the effect of temperature upon the filtration rate of a mineral-containing coal liquid, designated as Feed D, in admixture with calcite. In these tests a coal liquid distillate fraction boiling between 120° and 368° F. (49° and 187° C.) was added independently of and prior to the additive of the calcite, which was sprinkled into the coal liquid as a solid. In none of the tests was a mixture of calcite and light oil added to the coal liquid. The pressure drop for each test was 80 psi (5.6 kg/cm$^2$), and the temperature of the liquid was either 400° or 500° F. (204° or 260° C.). The reported filtration rates are for the first minute of filtration.

| Coal liquid | Filtration temperature-°F. (°C.) | Additive weight percent | Filtration rate (g/min) |
|---|---|---|---|
| Feed D | 500 (260) | none | 2.6 |
| Feed D | 500 (260) | 5% light oil | 3.9 |
| Feed D | 500 (260) | 5% light oil + 1% calcite | 4.3 |
| Feed D | 400 (204) | 5% light oil | 3.0 |
| Feed D | 400 (204) | 5% light oil + 1% calcite | 2.8 |
| Feed D | 400 (204) | 9% light oil | 3.7 |
| Feed D | 400 (204) | 9% light oil + 1% calcite | 3.7 |
| Feed D | 400 (204) | 9% light oil + 2% calcite | 3.4 |
| Feed D | 400 (204) | 14% light oil | 4.8 |
| Feed D | 400 (204) | 14% light oil + 1% calcite | 4.5 |

The above data show that at a filtering temperature of 500° F. (260° C.), the use of a light oil without calcite increased the filtration rate, and that the addition of calcite resulted in a further improvement in the filtration rate. At a filtration temperature of 400° F. (204° C.), the presence of progressively increasing amounts of light oil provided progressively improved filtration rates due to a reduction in viscosity, but the addition of calcite either did not further increase or slightly reduce the filtering rate. These data indicate that the beneficial effect of calcite is temperature dependent and strongly indicates that the effect exerted by the calcite is chemical in nature. If the effect exerted were mechanical in nature, as in the case of a conventional filter aid, an advantage in the use of calcite would have also been apparent in the tests performed at 400° F. (204° C.).

We claim:

1. A process for filtering particles of coal minerals from a coal liquid in which they are suspended comprising adding between about 1 and 100 grams per liter of a calcium salt selected from the group consisting of calcium carbonate, calcium acetate and $CaCO_3.MgCO_3$ to said coal liquid prior to the filtration step, performing said filtration step with the coal liquid at a temperature above about 475° F., said calcium salt increasing the rate of said filtration of said coal mineral particles from said coal liquid.

2. The process of claim 1 wherein the calcium salt is calcium acetate.

3. The process of claim 1 wherein a precoat material is applied to the filter.

4. The process of claim 1 wherein the calcium salt is added to the filter as a precoat material.

5. The process of claim 1 wherein the ratio of said calcium salt to said coal liquid is between about 10 to 50 grams per liter and said coal liquid contains carbon dioxide.

6. The process of claim 1 wherein said coal liquid is at at temperature above about 500° F. during the filtration step.

7. A process for filtering particles of coal minerals from a coal liquid in which they are suspended comprising adding between about 1 and 100 grams per liter of calcium carbonate to said coal liquid prior to the filtration step, performing said filtration step with the coal liquid at a temperature above about 475° F., said calcium carbonate increasing the rate of filtration of said coal mineral particles from said coal liquid.

8. The process of claim 7 wherein said calcium carbonate is calcite.

9. The process of claim 7 wherein said calcium carbonate is aragonite.

10. The process of claim 7 wherein said calcium carbonate is $CaCO_3.MgCO_3$.

11. The process of claim 7 wherein calcium carbonate is added to the filter as a precoat material.

12. The process of claim 7 wherein the ratio of calcium carbonate to coal liquid is between about 10 to 50 grams per liter.

13. The process of claim 7 wherein the coal liquid is at a temperature above about 500° F. during the filtration step.

14. The process of claim 7 wherein the added calcium carbonate is in the form of a solid.

* * * * *